US005934189A

United States Patent [19]

Mistyurik et al.

[11] Patent Number: 5,934,189

[45] Date of Patent: Aug. 10, 1999

[54] HAND-HELD LABELER

[75] Inventors: John D. Mistyurik, Troy; James A. Makley, Springboro, both of Ohio; Paul H. Hamisch, Jr., Las Vegas, Nev.; Ronald L. Fogle, Springboro, Ohio

[73] Assignee: Monarch Marking Systems, Inc., Dayton, Ohio

[21] Appl. No.: 09/024,142

[22] Filed: Feb. 17, 1998

Related U.S. Application Data

[62] Division of application No. 08/701,259, Aug. 22, 1996.

[51] Int. Cl.[6] ..... B41J 47/44

[52] U.S. Cl. ..... 101/93; 101/93.37; 101/93.47

[58] Field of Search ..... 101/93, 288, 93.37, 101/93.47, 94; 400/88, 174, 175, 354, 691, 692, 693, 694

[56] References Cited

U.S. PATENT DOCUMENTS 3,890,188 6/1975 Sams .
4,104,106 8/1978 Hamisch, Jr. .
4,125,421 11/1978 Hamisch, Jr. .
4,142,932 3/1979 Hamisch, Jr. .
4,148,679 4/1979 Hamisch, Jr. .
4,227,457 10/1980 Hamisch, Jr. .
4,257,326 3/1981 Sato .
4,261,783 4/1981 Finke .
4,280,863 7/1981 Hamisch, Jr. et al. .
4,350,554 9/1982 Pabodie .
4,352,710 10/1982 Makley .
4,419,930 12/1983 Holland-Letz .
4,440,592 4/1984 Sato et al. .
4,668,326 5/1987 Mistyurik .
4,813,355 3/1989 Stork ..... 101/288
5,486,259 1/1996 Goodwin et al. .

*Primary Examiner*—John Hilten
*Attorney, Agent, or Firm*—Joseph J. Grass

[57] ABSTRACT

There is disclosed a hand-held labeler which is easy to load, clean and service. The labeler has a gear driven print head wherein the print head is situated on an upper housing section and the print head is actuated from a lower housing section. The upper housing section can be moved to an open position without interfering with the maintenance of the drive connection with the print head or the advance of a label carrying web through the labeler.

7 Claims, 8 Drawing Sheets

HAND-HELD LABELER

CROSS REFERENCE TO RELATED APPLICATION

This is a division of application Ser. No. 08/701,259, filed Aug. 22, 1996.

BACKGROUND OF THE INVENTION

1. Field of the Invention

This invention relates to the field of hand-held labelers.

2. Brief Description of the Prior Art

The following U.S. Pat. Nos. are made of record: 3,890,188 to Sams; 4,104,106 to Hamisch, Jr.; 4,125,421 to Hamisch, Jr.; 4,142,932 to Hamisch, Jr.; 4,148,679 to Hamisch, Jr.; 4,227,457 to Hamisch, Jr.; 4,257,326 to Sato; 4,261,783 to Finke; 4,280,863 to Hamisch, Jr. et al; 4,350,554 to Pabodie; 4,352,710 to Makley; 4,440,592 to Sato; 4,668,326 to Mistyurik; and 5,486,259 to Goodwin et al.

SUMMARY OF THE INVENTION

This invention relates to an improved, easy to load, simple, low cost, easy to manufacture, user-friendly, durable hand-held labeler for printing and applying pressure sensitive labels.

According to a specific embodiment of the invention, there is provided a hand-held labeler with a housing having an upper housing portion or section and a lower housing portion or section. The upper housing section is movable relative to the lower housing section to allow access to the inside of the housing for loading of labels, for cleaning and for removing stray labels and jams. The upper housing section mounts a print head for reciprocating straight line movement. The lower housing section has a handle and mounts a manually engageable actuator, a toothed driver, gears and a pawl and ratchet mechanism. The actuator, one of the gears and the pawl and ratchet mechanism are operable to advance the driver. There are racks on the print head which mesh with the gears when the upper housing section is in the closed or operating position. However, when the upper housing section is in the open position the racks are out of mesh with the gears. The lower housing section mounts a label roll about an axis and the upper housing section can rotate to its open position about the axis. When the print head is driven into its printing position in cooperation with the platen, an inker arm is cammed so that the ink roller which it carries inks the print head. The upper housing section is releasably latched to the lower housing section. There is an interlock between the print head and the latch to prevent the latch from becoming unlatched unless the print head is essentially in its initial position. The interlock also helps keep the print head from moving out of its initial position when the latch is unlatched. The latch also cooperates with the print head to help guide the print head during movement. There is a movable member in the housing which provides a brake surface, guides the carrier web, mounts a die roll, which partially surrounds the toothed driver, and which has a finger-engageable recess. Another member mounts a brake roll and a direction changing roll. An assembly including the platen and the delaminator is positionable selectively relative to an applicator so that the printer with a minimum of structural change, such as repositioning the applicator, can dispense labels of different lengths into underlying relation to an applicator.

BRIEF DESCRIPTION OF THE DIAGRAMMATIC DRAWINGS

DETAILED DESCRIPTION OF A PREFERRED EMBODIMENT

Figure 1:
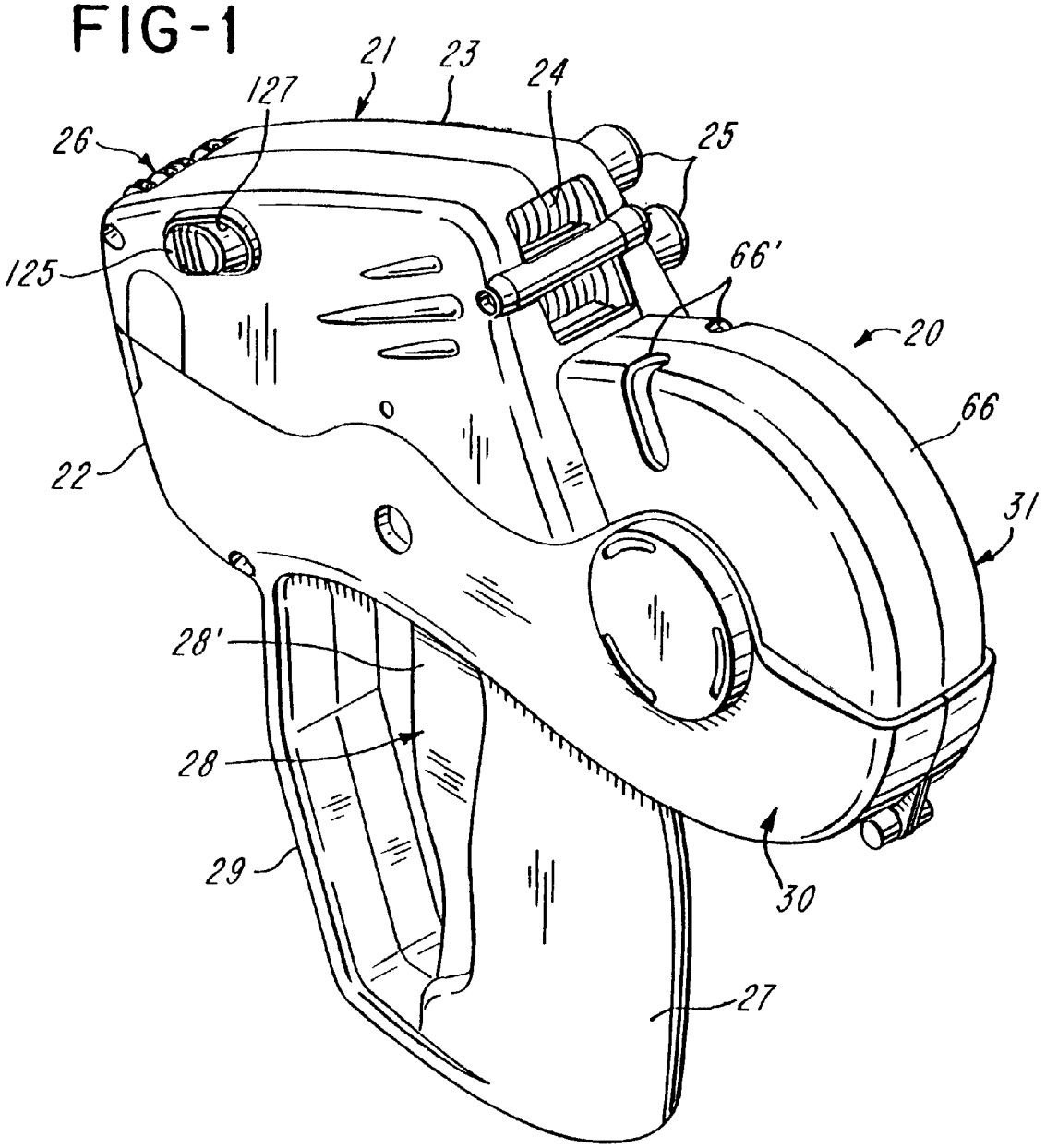
FIG. 1 is a perspective view of a hand-held labeler in accordance with the invention.

With reference to FIG. 1, there is shown hand-held labeler generally indicated at 20. The labeler 20 has a housing or frame generally indicated at 21 having a first or lower housing section 22 and a second or upper housing section 23. The housing 21 mounts a two-line print head 24 having a pair of selectors 25. An applicator generally indicated at 26 is disposed at the upper front portion of the housing 21. The housing 21 has a downwardly extending manually graspable handle 27 at which a manually engageable actuator generally indicated at 28 is disposed. A knuckle guard 29 is connected to the underside of the lower housing section 22 and to the lower end portion of the handle 27. The space between the knuckle guard 29 and the actuator 28 accommodates the user's fingers.

Figure 2:
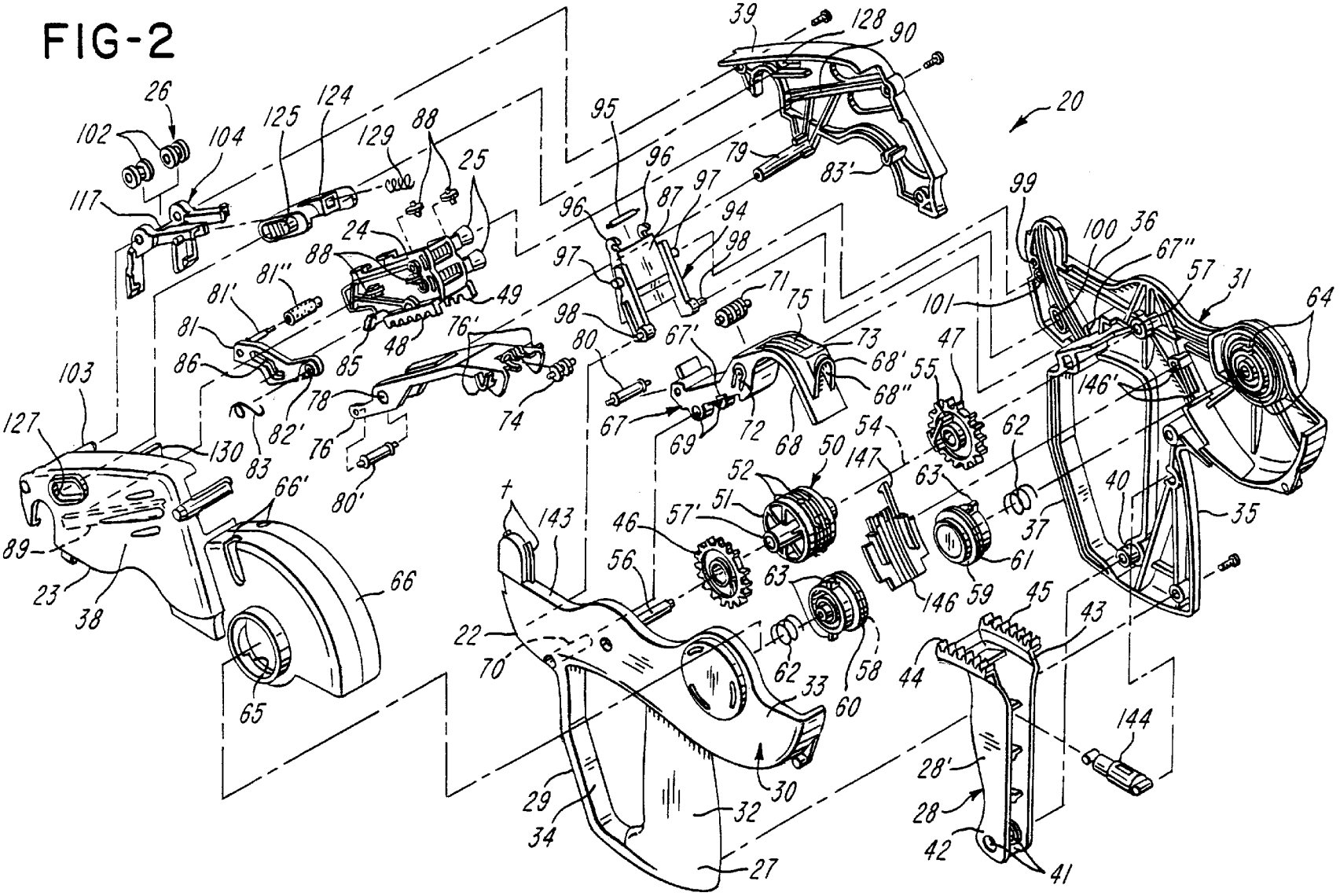
FIG. 2 is an exploded perspective view of the labeler depicted in FIG. 1.
Figure 16:
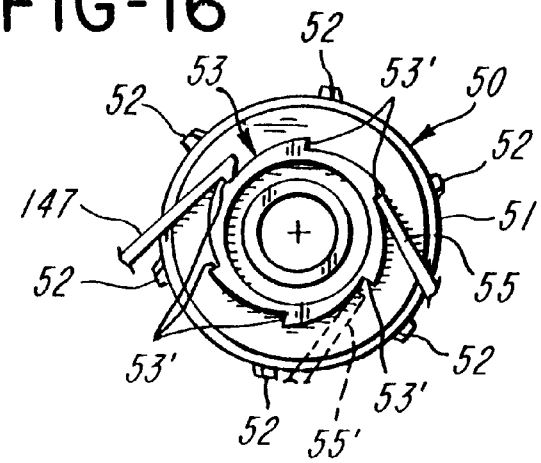
FIG. 16 is a side elevational view of the feed wheel and ratchet wheel and feed and anti-backup pawls.

With reference to FIG. 2, the lower housing section 22 has a left side portion generally indicated it 30 and a right side portion generally indicated at 31. The left side portion 30 includes a handle portion 32 of the handle 27, a body portion 33, and a knuckle guard portion 34 of the knuckle guard 29. The right side portion generally indicated at 31 includes a handle portion 35 of the handle 27, a body portion 36, and a knuckle guard portion 37 of the knuckle guard 29. The upper housing section 23 includes a left body portion 38 and a right body portion 39. The actuator 28 is shown to comprise a lever 28' which is pivotally mounted on a post 40 passing through a through hole 41 in the lever 28'. The post 40 is disposed at the lower end portion of the handle portion 35 and the hole 41 is disposed at lower end portion 42 of the lever 28'. Upper portion 43 of the lever 28' has a pair of spaced arcuate gear sections or gears 44 and 45. The gear sections 44 and 45 mesh with gears 46 and 47 which in turn mesh with gears or racks 48 and 49 on the print head 24. A toothed driver 50 in the form of a feed wheel 51 having peripherally spaced teeth 52 is disposed between the gears 46 and 47. A ratchet wheel 53 (FIG. 16) is formed integrally with the feed wheel 51. The ratchet wheel 53 is not visible in FIG. 2 because it is on the far side of the feed wheel 51. The gears 46 and 47, the feed wheel 51 and the ratchet wheel 53 are coaxial along axis 54. The gears 46 and 47 are identical. The gear 47 has an integrally formed pawl 55 which cooperates with the ratchet wheel 53 to advance the feed wheel 51 stepwise. The gear sections 44 and 45, the gears 46 and 47, and the racks 48 and 49 are considered to provide gearing between the actuator 28 and the print head 24 and the feed pawl 55. This gearing is part of the drive connection between the actuator 28, the print head 24, and the driver 50. The integral feed wheel 51 and ratchet wheel 53 and the gears 46 and 47 are rotatable on a post 56 on the body portion 33. The post 56 is received in a recess 57 in the portion 36. The gears 46 and 47 are received on a shaft 57' which is integral with the feed wheel 51 and the ratchet wheel 53.

Figure 4:
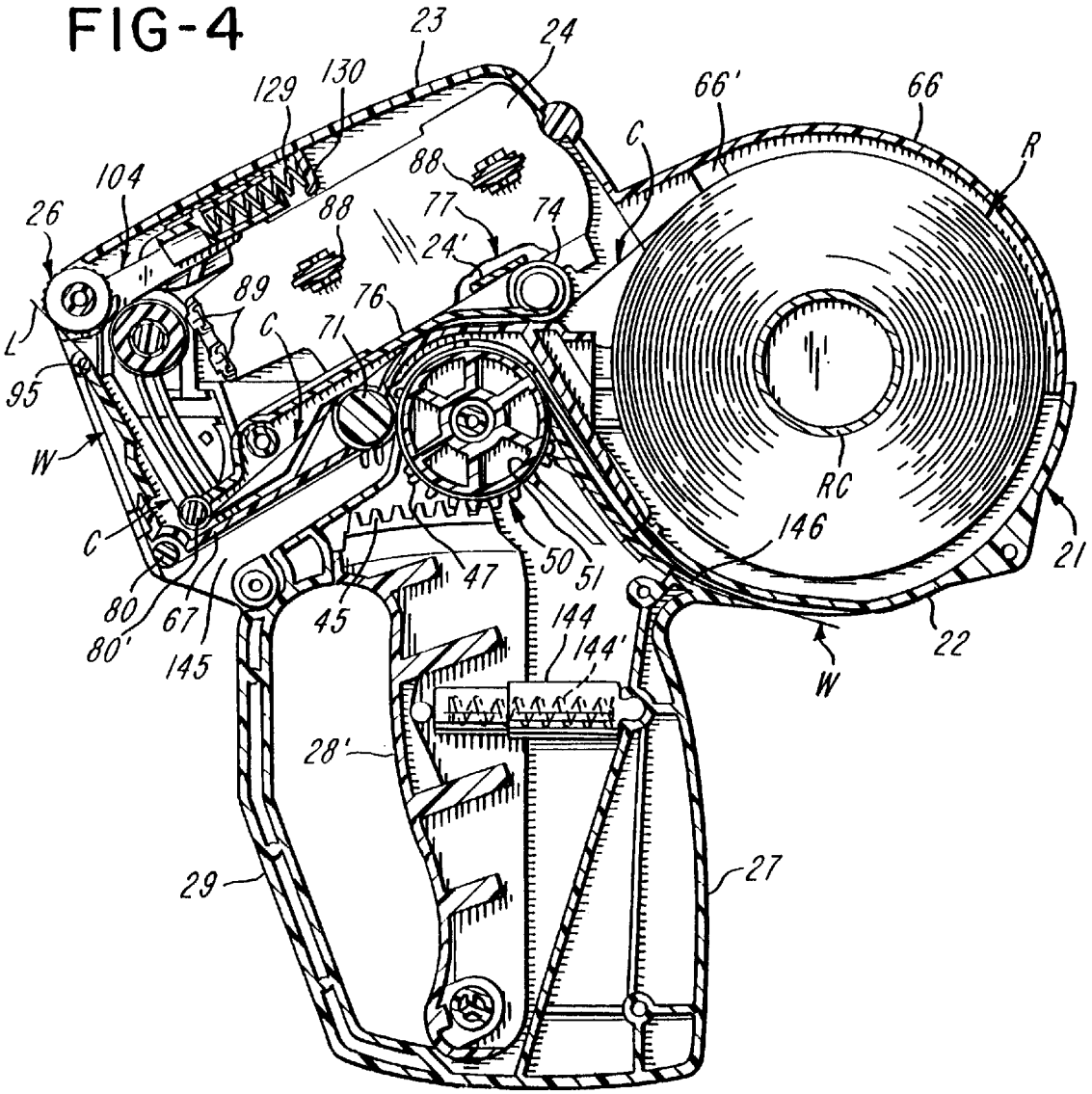
FIG. 4 is a vertical sectional view of the labeler.
Figure 5:
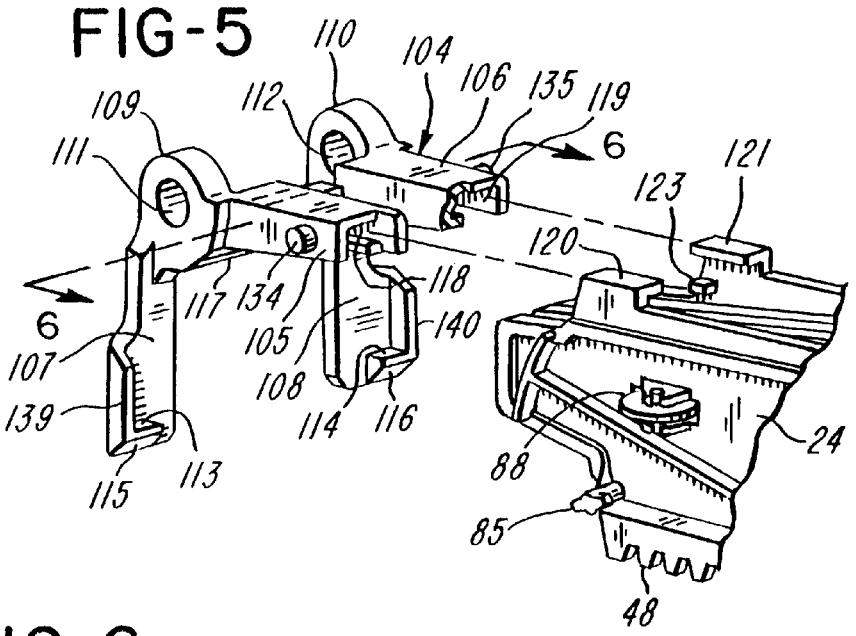
FIG. 5 is a fragmentary perspective view showing a fragmentary portion of the print head and a multifunctional member for latching the housing sections of the labeler, for guiding the print head and for preventing movement of the print head out of its initial position when the member is unlatched.

As shown in FIG. 4, a roll R of a composite label web C is shown to be mounted in the housing 21. The composite label web C is wound on a core RC and includes a series of labels L releasably adhered by pressure sensitive adhesive to a carrier web W.

Referring again to FIG. 2, the core RC is mounted on annular rings 58 and 59 rotatably mounted by a pair of identical roll mounting members 60 and 61. The mounting members 60 and 61 are biased toward each other by compression springs 62. The mounting members 60 and 61 are axially movable relative to each other and have respective pairs of cam followers 63 guided axially in opposed pairs of slots 64. The body portion 38 has cams 65 cooperable with the cam followers 63 when the upper housing section 23 is being opened and closed. When the upper housing section 23 is being opened from the position shown in FIGS. 1 and 4 to the open position shown in FIG. 13 the cams 65 acting on the cam followers 63 move the mounting members 60 and 61 apart to enable a label roll R to be inserted or to enable a spent core RC to be removed. When the upper housing section 23 is returned to its closed position, the springs 62 urge the mounting members relatively toward each other. It is readily apparent that the upper housing section includes a cover portion or cover 66. The user can see the amount of the roll R which is mounted inside the cover portion 66 by means of slots 66'. The arrangement for mounting the label roll R described above is the same as the arrangement disclosed in U.S. Pat. No. 4,668,326, the disclosure of which is incorporated herein by reference.

Figure 3:
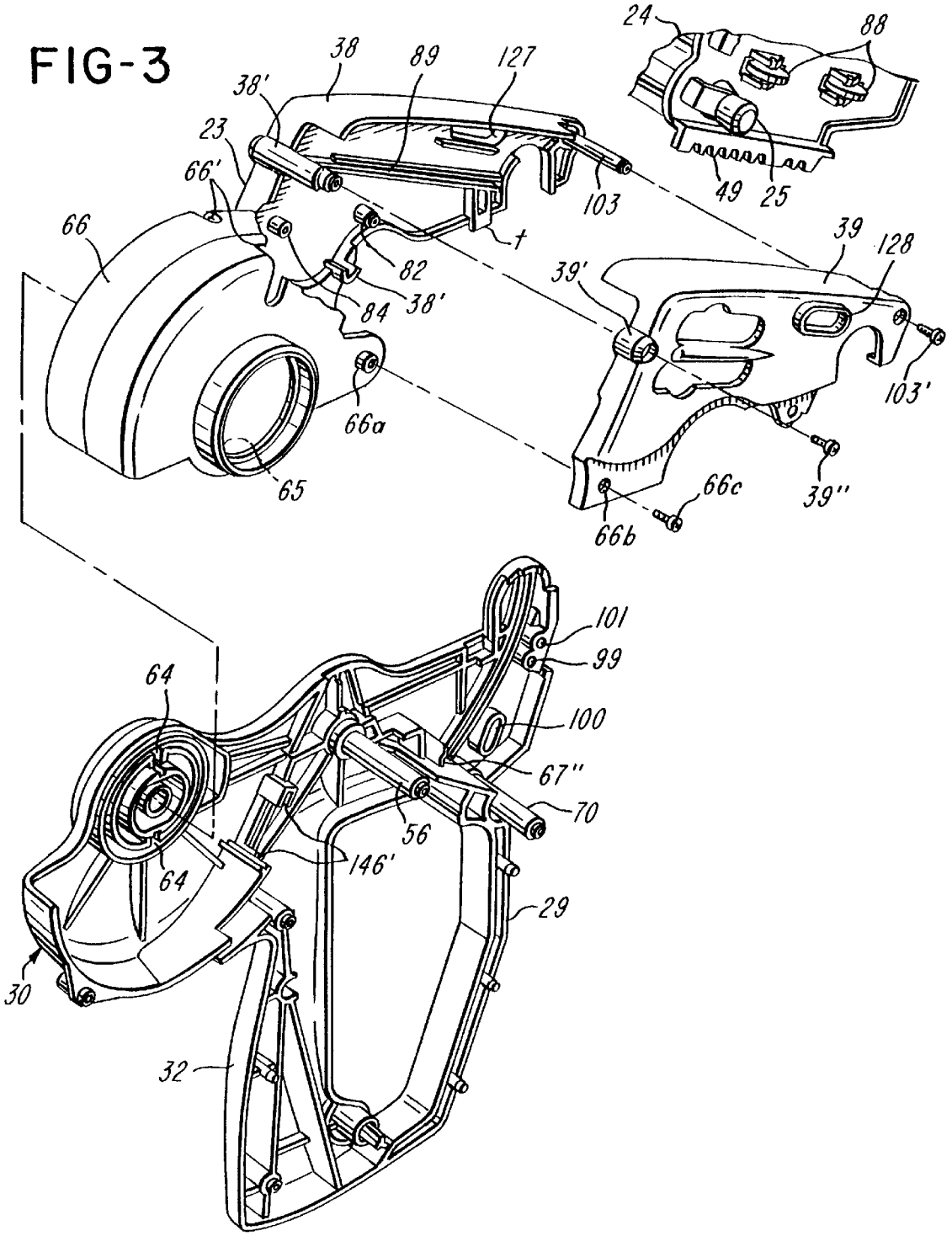
FIG. 3 is an exploded perspective view of certain components of the housing of the labeler.

FIGS. 2 and 4 show a one-piece multifunction member generally indicated at 67 which has an arcuate portion 68 received about and partially surrounding the toothed driver 50. The member 67 has a pair of spaced holes 69 by which the member 67 is pivotally mounted to a post 70 (FIG. 3). The member 67 also rotatably mounts a die roller 71 on spaced flexible arms 72. The member 67 includes a brake surface 73 with which a brake roll 74 cooperates, and further includes a guide surface 75 for the web C. The member 67 has opposed projections 67' which are releasably held to projections 67". The member 67 has a portion 68' with a finger-engageable recess 68".

A multifunction member 76 loosely rotatably mounts the brake roll 74. The brake roll 74 cooperates with the composite label web C and the brake surface 73 to provide a brake generally indicated at 77 (FIG. 4). The composite label web C passes between the brake roll 74 and the brake surface 73. The print head 24 has a transverse bar 24' which is in contact with the brake roll 74 when the print head 24 is at and near its initial position as shown in FIG. 4. The brake roll 74 is thus not able to rotate. In this position the bar 24' presses the brake roll 74 against the composite label web C which is in turn pressed against the brake surface 73. The bar 24' moves as a unit with the print head 24. When the print head 24 moves away from the initial position shown in FIG. 4, the bar 24' loses contact with the brake roll 74, and because the brake roll 74 is now free to rotate, the braking force is no longer applied to the web C and the web C is thus free to move under the brake roll 74. The member 76 (FIG. 2) has a through hole 78 which receives a mounting post 79 on the body portion 39. The member 76 rotatably mounts a direction changing or transfer roller 80'. The member 76 has opposed resilient C-shaped sockets 76' which secure the member 76 to the body 38 at connectors 38' (FIG. 3). The member 76 is positioned between the racks 48 and 49 and also serves as a guide for the web C when the labeler 20 is being threaded with a new web C.

Figure 6:
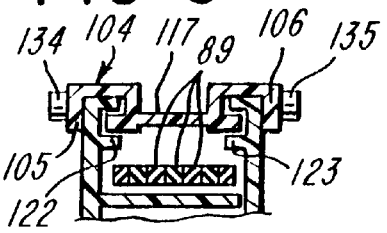
FIG. 6 is a sectional view taken along line 6—6 of FIG. 5.
Figure 12:
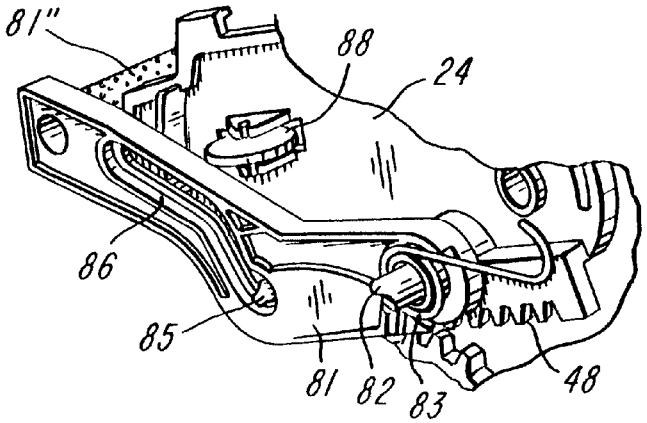
FIG. 12 is a fragmentary perspective view showing the manner in which the inker arm is mounted in relation to the print head.

An inker arm 81 (FIGS. 2 and 12) is pivotally mounted on a post 82 (FIGS. 3 and 12) passing through a hole 82'. A spiral spring 83 urges the inker counterclockwise. The spring 83 is connected to the inker arm 81 and to a post 84 (FIG. 3). The print head 24 carries a pin or driver 85 received and captive in a cam slot 86 in the inker arm 81. As the print head 24 moves from its initial position (FIG. 4) and its printing position in cooperation with a platen 87, the inker arm 81 pivots and an ink roller 81" mounted on inker shaft 81' inks printing members 89 (FIGS. 4 and 6). The printing members 89 are also inkable on the return movement of the inker arm 81.

Figure 14:
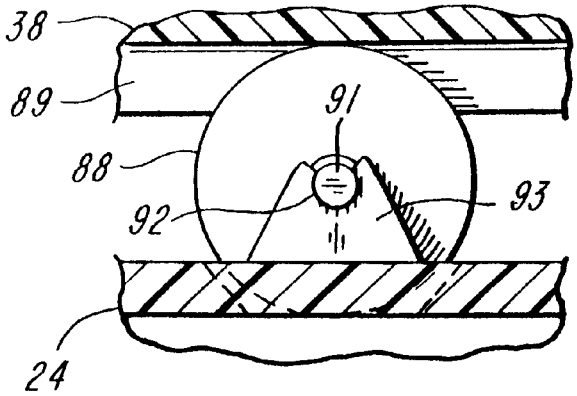
FIG. 14 is a fragmentary sectional view of a captive guide roller operating in a guide groove in the housing.
Figure 15:
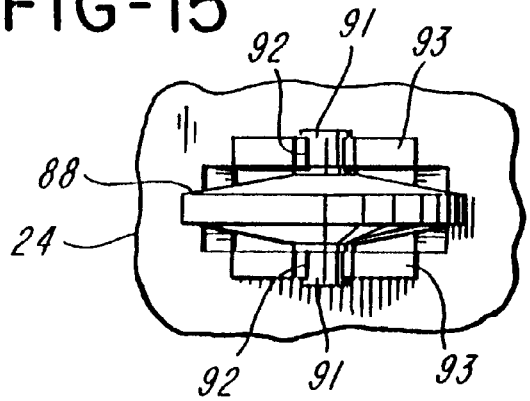
FIG. 15 is an elevational view of the roller and its mounting structure shown in FIG. 14.

As shown, the print head 24 has four identical guide rollers 88. There are preferably two rollers 88 connected to each side of the print head 24. Two of the rollers 88 are guided in and by a guide groove or track 89 (FIG. 3) and the other two rollers 88 are guided by a guide groove or track 90 (FIG. 2). With reference to FIGS. 14 and 15 in particular, each roller 88 has opposite, integrally molded stub ends 91. Each stub end 91 is snap-fitted into a C-shaped socket 92 in a respective mounting member 93. Thus, a pair of the mounting members 93 mounts each roller 88. Because the rollers 88 can be snap-fitted to the print head 24 during assembly, the manufacture and replacement of a print head is greatly facilitated over prior art ball strips which are loose and can impede assembly of the labeler 20. The rollers 88 remain connected to the print head 24 even through the housing 21 flexes or deflects, as for example when the labeler is dropped. Use of ball bearing strips in the labeler 20 could result in the ball bearing strips falling out of their tracks in the event the labeler 20 were dropped. Although FIGS. 14 and 15 show the construction of only one roller 88 and its associated mounting members 93, all four such rollers 88 and their mounting members 93 are identical. The rollers 88 preferably bottom in their respective guide tracks 89 and 90. The guide tracks 89 and 90 are preferably generally V-shaped and the tapering sides of the guide rollers 88 preferably have very straight clearance with the sides of the respective V-shaped guide tracks 89 and 90.

An assembly generally indicated at 94 (FIG. 2) which includes a platen 87, rotatably mounts a delaminator 95 in the form of a rotatable peel roller. The delaminator 95 is mounted in sockets 96. The assembly 94 has opposed locators 97 and 98. The assembly 94 can be used in a labeler 20 that has a two-line print head 24 for printing two lines of data as illustrated, or a one-line print head (not shown) for printing a single line of data. When it is desired to print with a labeler 20 with a two-line print head, the locators 97 and 98 are positioned in opposed locating recesses or locators 99 and 100, respectively. The locator 100 is an elongate recess. When printing in a labeler 20 with a one-line print head, the locators 97 and 98 are received in opposed locating recesses or locators 101 and 100 respectively. For such a one-line print head the applicator 26 is also positioned differently with respect to the delaminator 95.

The applicator 26 is shown to include a pair of applicators rolls 102, although a single applicator roll which is as wide as the two rolls 102 can be used. The rolls 102 are rotatably received on a post 103. the post 103 is molded integrally with the body portion 38. A multifunction member generally indicated at 104 is shown in FIGS. 2, 4, 5, 6, 7, 9, 11 and 13. With reference to FIGS. 5, 6, 7 and 9, the member 104 has a pair of parallel arms or guides 105 and 106 and a pair of parallel latch members 107 and 108. The arm 105 and the latch member 107 are joined at a hub 109, and the arm 106 and the latch member 108 are joined at a hub 110. The hubs 109 and 110 have axially aligned holes 111 and 112 which receive the post 103 (FIG. 3). The hubs 109 and 110 straddle the applicator 26. The latch members 107 and 108 have respective teeth or latch shoulders 113 and 114 and cam faces 115 and 116. The hubs 109 and 110 are joined by an integrally molded bar 117. The arms 1 05 and 106 have respective guide channels 118 and 1 9 for receiving opposed angle-shaped projections 120 and 121 on the print head 24. In the initial position of the print head 24, the projections 120 and 121 are slightly short of the channels 118 and 119. Thus, the member 104 can pivot clockwise from the position shown in FIG. 5. It is noted that the print head 24 also has a pair of projections 122 and 123 which are in slidable contact with the undersides of the respective arms 105 and 106. As the print head 24 is driven from its initial position to the printing position at which the print head 24 cooperates with the platen 87 to print on a label L, the arms 105 and 106 cooperate with the projections 120 and 122, and 121 and 123, respectively to help guide the print head 24. This guiding of the print head 24 supplements the guiding of the print had 24 by the rollers 88 cooperating in guide slots 89 and 90. The arms 105 and 106 add stability to the print head 24 as it moves from its initial position to the printing position. It should be noted that when the projections 120 and 121 are in the guide channels 118 and 119, the member 104 cannot be moved and the latch members 107 and 108 cannot be unlatched from the teeth 136 and 137. The projections 120 through 123, or any of them, prevent unlatching of the upper housing section 23 from the lower housing section 22 unless the print head 24 is at or near its initial or home position. It should also be noted that the very small amount of movement of the print head 24 before either set of projections 120 and 121 or 122 and 123 is contacted by the ends of the arms 105 and 106 is insufficient to result in loss of registration between the racks 48 and 49 and the gears 46 and 47 either before or after the upper housing section 23 is moved to its closed position.

The left body portion 38 and the right body portion 39 are held together as a unit by the post 103 and a screw 103', by posts 38' and 39' and a screw 39", and by a stud 66*a* received in a hole 66*b* and a screw 66*c*.

Figure 9:
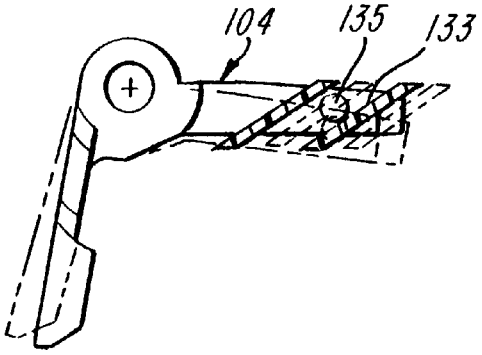
FIG. 9 is a side elevational view of the member shown in FIGS. 5 through 7 in solid line and phantom line positions.
Figure 10:
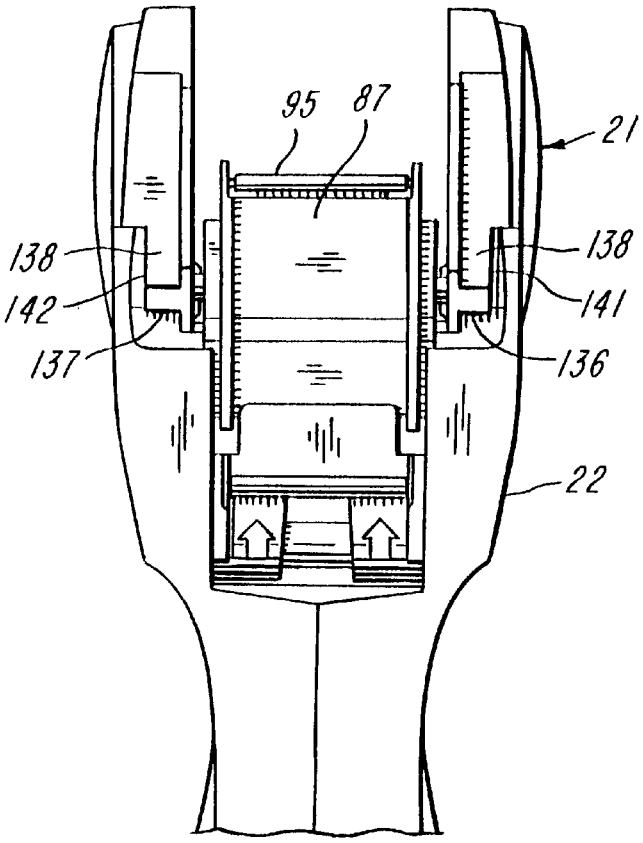
FIG. 10 is a front elevational view of the lower housing section of the labeler.
Figure 11:
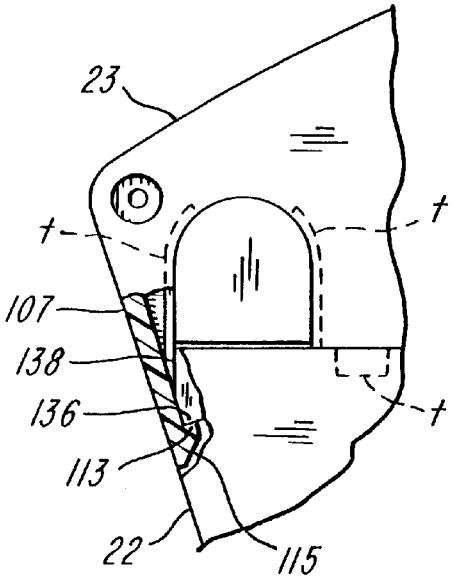
FIG. 11 is a fragmentary side elevational view showing the upper and lower housing sections latched to each other.
Figure 13:
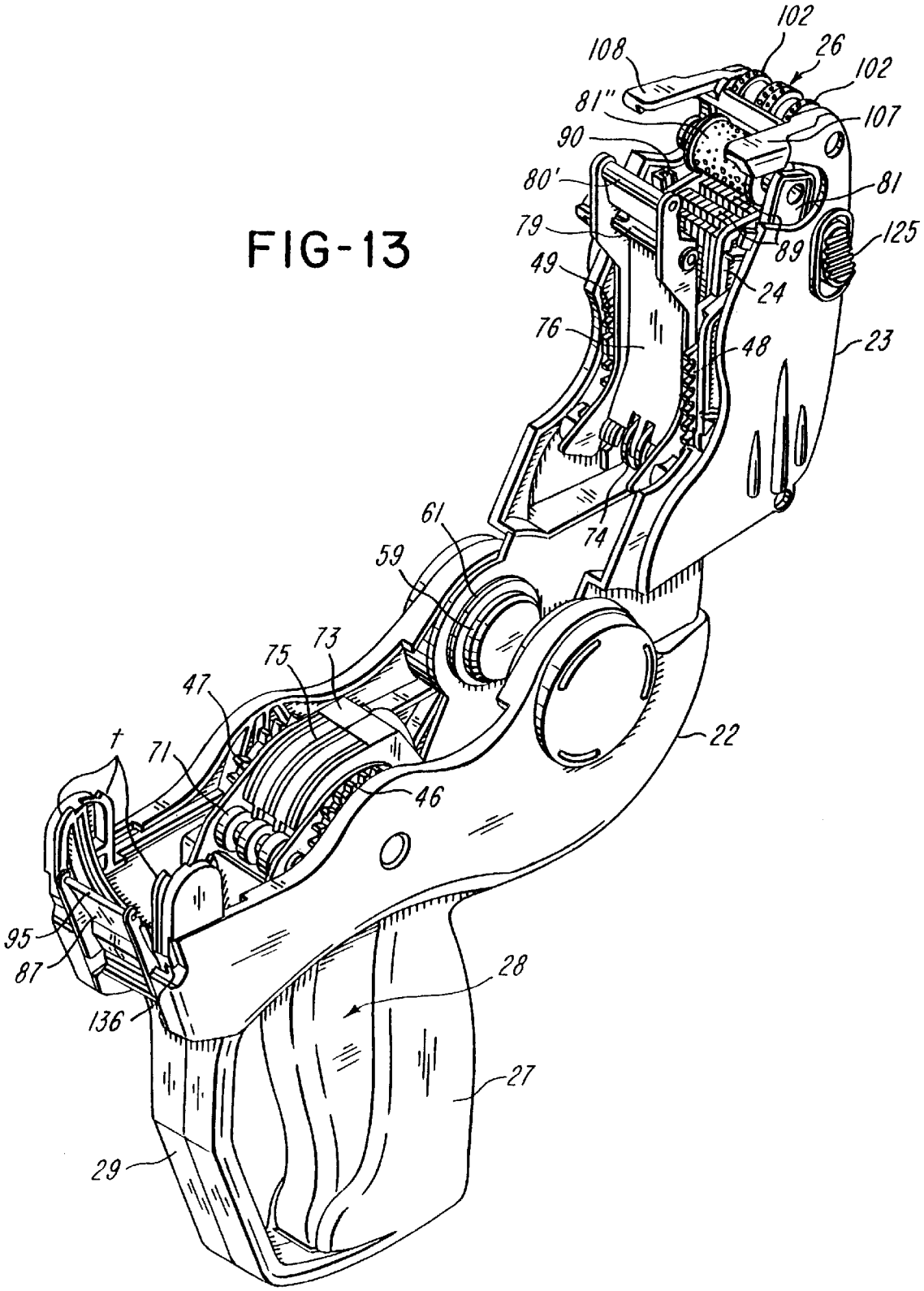
FIG. 13 is a perspective view of the labeler in its open position.

The member 104 is controlled by a manually engageable slide generally indicated at 124. The slide 124 has two finger-engageable projections 125 and 126 received in and guided in respective slots 127 and 128. A compression spring 129 bearing against a projection 130 on the body portion 38 is received in and bottoms in a pocket 131 in the slide 124. The spring 129 urges the slide 124 toward the front of the labeler 20. The slide 124 has a pair of opposed parallel channels 132 and 133 for receiving respective opposed projections or pins 134 and 135 on the arms 105 and 106. When the member 104 is in the solid line position as shown in FIG. 9, the spring 129 urges the member 104 counterclockwise. This holds the teeth 113 and 114 gripped to teeth 136 and 137 of the lower housing section 22. In order to release the latch members 107 and 108, the user grasps projections 125 and 126 and slides the slide 124 rearwardly against the action of the spring 129, and this causes the member 104 to pivot clockwise to the phantom line position shown in FIG. 9, thereby unlatching the upper housing section 23 from the lower housing section 22 and allowing the upper housing section 23 to be moved to a fully open position as shown in FIG. 13. When the upper housing section 23 is out of its operating or closed position, the spring 129 moves the member 104 to its phantom line position shown in FIG. 7; in this position the arms 105 and 106 are in the path of the projections 120 and 121 and the print head 24 is thus prevented from moving out of its initial position. This assures that when the upper housing section 23 is in its open or non-operating position or even in a partially open position, the registration between the racks 48 and 49 on the one hand and the gears 46 and 47 on the other hand is maintained. Thus, when the housing section 23 is moved into the closed position, the racks 48 and 49 remain registered with the gears 46 and 47. Likewise, if the slide 124 is moved against the action of the spring 129 while the housing section 23 is in the open position, the print head 24 will not move out of its initial position because the arms 105 and 106 are in the path of the projections 122 and 123 as shown in solid lines in FIG. 7, thereby preventing movement of the print head 124. The member 104 thus provides an interlock which enables the upper housing section to be unlatched in accordance with the user's desire, but prevents movement of the print head when the upper housing section 23 is partially or fully open. In addition, the member 104 provides additional guiding of the print head 24 at the printing position where the print head 24 coacts with the platen 87.

It is noted that the cam faces 115 and 116 of the latch members 107 and 108 cooperate with the front surfaces 138 of the housing 21 as the upper housing section 23 is moved into the closed position. Ledges 139 and 140 on the latch members 107 and 108 cooperate with housing surfaces 141 and 142 to help keep the upper housing section 23 aligned with the lower housing section 22 when the upper housing section 23 is in the closed position. The upper housing section 23 and the lower housing section 22 likewise have various cooperating ledges or tabs t at the parting line 143 to align the upper housing section 23 with the lower housing section 22 as the upper housing section 22 is nearing the closed position and to assist in maintaining the housing sections 22 and 23 aligned.

In the position shown in FIG. 4, all the components are in their respective home positions. A spring assembly 144, of the type shown at 515 in U.S. Pat. No. 4,104,106, has a compression spring 144' that urges the actuator 28 to its home position.

Figure 7:
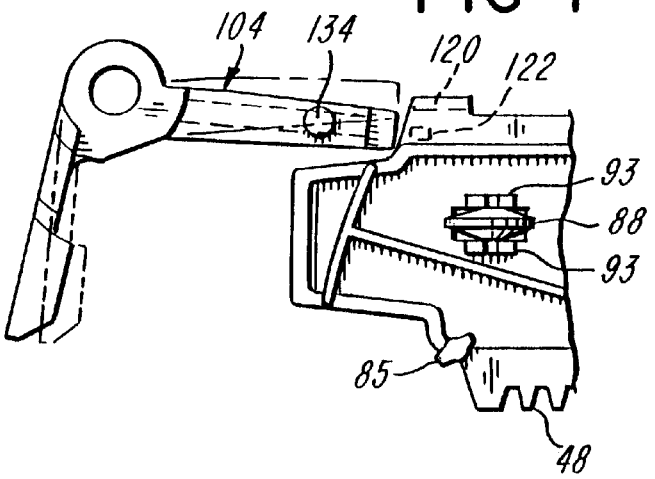
FIG. 7 is a side elevational view of the member shown in perspective in FIG. 5 in its unlatch positions.
Figure 8:
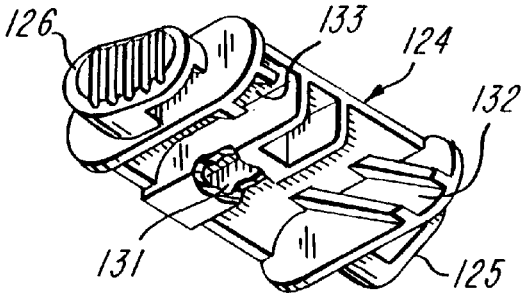
FIG. 8 is a perspective view of an actuator for the member showing in FIGS. 5 through 7.

In order to load the labeler 20, the user grasps the projections 125 and 126 and moves the slide 124 against the force of the spring 129 to pivot the member 104 clockwise to the solid line position in FIG. 7, thereby unlatching the upper housing section 23 from the lower housing section 22.

The upper housing section 23 can now be pivoted to its open position. Upon release of the projections 125 and 126, the spring 129 returns the slide 124, and the member 104 moves to the position shown in phantom lines in FIG. 7. At the open position, the mounting members 60 and 61 have moved apart sufficiently to enable the roll R to be inserted and mounted on the rotatable rings 58 and 59. Thereupon, the composite label web C is laid over the brake surface 73, the guide surface 75, the delaminator 95 and beyond. Thereupon the upper housing section 23 can be closed and the web C inserted about roller 80 and into an inlet 145 (FIG. 4). From there the web C is passed between the feed wheel 51 and the die roller 71. The teeth 52 engage in holes (not shown) through the web C and the web C is advanced beneath arcuate portion 68 as the actuator 28 is repeated manually operated. The composite web C passes through an exit chute 146' and out of the labeler 20. As the tension in the composite web C increases, labels L are peeled or delaminated from the carrier web W at the delaminator 95. Thereafter, only the carrier web W passes about the delaminator 95 because labels L have been delaminated therefrom and labels L are dispensed into label applying relationship with respect to the applicator 26.

It is apparent that for each complete actuation of the actuator 27, the gears 46 and 47 rotate and the print head 24 is first moved to the printing position in cooperation with the platen 87. During the movement to the gear 47, the pawl 55 moves to a ready position shown at 55' in FIG. 16 at which a tooth 53' of the ratchet wheel 53 can be driven by the action of the spring assembly 144 when the actuator 27 is released. Thereupon, the pawl 55 advances the ratchet wheel 53 to advance the web W and advance the just printed label L from the printing position to the label applying position in underlying relation to the applicator 26. It is to be noted that a deflector 146 helps to release the web W from the teeth 52 on the feed wheel 51. The deflector 146 is secured in opposed pairs of pockets 146'. An anti-backup pawl 147 molded integrally with the deflector 146 prevents retrograde movement of the ratchet wheel 53 and its associated feed wheel 51, thereby preventing loss of tension in the feed path between the brake 77 and the feed wheel 51.

The labeler 20 is composed entirely of molded plastics material except for springs 83 and 129, spring 144' within the spring assembly 144, various screws, the elastomeric printing members 89, the elastomeric applicator rolls 102, and the outer elastomeric part of the brake roll 74.

Other embodiments and modifications of the invention will suggest themselves to those skilled in the art, and all such of these as come within the spirit of this invention are included within its scope as best defined by the appended claims.

We claim:

1. A hand-held labeler for printing and applying pressure sensitive labels releasably secured to a carrier web, the labeler comprising: a housing having a handle, a print head mounted for reciprocating straight line movement in the housing, a platen cooperable with the print head, an actuator disposed at the handle, a driver for advancing the carrier web, a delaminator for delaminating printed labels from the carrier web, an applicator for applying printed labels, the actuator being coupled to the driver and to the print head to print labels and to advance the carrier web, spaced apart straight guides within the housing, guide rollers connected to the print head in guided relationship with the guides, the guide rollers being snap-fitted to the print head, the guide rollers being of one-piece molded plastics construction and having integrally molded opposed stub ends, and the print head having snap sockets for receiving the stub ends.

2. A hand-held labeler for printing and applying pressure sensitive labels releasably secured to a carrier web, the labeler comprising: a housing having a handle, a print head mounted for reciprocating straight line movement in the housing, a platen cooperable with the print head, an actuator disposed at the handle, a driver for advancing the carrier web, a delaminator for delaminating printed labels from the carrier web, an applicator for applying printed labels, the actuator being coupled to the driver and to the print head to print labels and to advance the carrier web, spaced apart straight guides within the housing, guide rollers connected to the print head in guided relationship with the guides, the guide rollers being snap-fitted to the print head, the guide rollers being of one-piece molded plastics construction and having integrally molded opposed stub ends, and the print head having snap sockets for receiving the stub ends, the snap sockets being arranged in pairs, and the stub ends for each roller being received in one pair of snap sockets.

3. A hand-held labeler for printing and applying pressure sensitive labels releasably secured to a carrier web, the labeler comprising: a housing having a handle, a print head mounted for reciprocating straight line movement in the housing, a platen cooperable with the print head, an actuator disposed at the handle, a driver for advancing the carrier web, a delaminator for delaminating printed labels from the carrier web, an applicator for applying printed labels, the actuator being coupled to the driver and to the print head to print labels and to advance the carrier web, spaced apart straight guides within the housing, guide rollers connected to the print head in guided relationship with the guides, the guide rollers being snap-fitted to the print head, the guide rollers being of one-piece molded plastics construction and having integrally molded opposed stub ends, the print head having snap sockets for receiving the stub ends, the snap sockets being arranged in pairs, and the stub ends for each roller being received in one pair of snap sockets, and the guides being formed directly in the housing.

4. A hand-held labeler for printing and applying pressure sensitive labels releasably secured to a carrier web, the labeler comprising: a housing having a handle, a print head mounted for reciprocating straight line movement in the housing, a platen cooperable with the print head, an actuator disposed at the handle, a driver for advancing the carrier web, a delaminator for delaminating printed labels from the carrier web, an applicator for applying printed labels, the actuator being coupled to the driver and to the print head to print labels and to advance the carrier web, spaced apart straight guides within the housing, and guide rollers mounted on the print head in guided relationship in the guides.

5. A hand-held labeler for printing and applying pressure sensitive labels releasably secured to a carrier web, the label comprising: a housing having a left side portion and a right side portion, a print head mounted for reciprocating straight line movement in the housing, a platen cooperable with the print head, an actuator disposed at the handle, a driver for advancing the carrier web, a delaminator for delaminating printed labels from the carrier web, an applicator for applying printed labels, the actuator being coupled to the driver and to the print head to print labels and to advance the carrier web, a straight guide on the left side portion, a straight guide on the right side portion, and guide rollers mounted on the print head in guided relationship in the guides.

6. A hand-held labeler for printing and applying pressure sensitive labels releasably secured to a carrier web, the labeler comprising: a housing having a handle, a print head mounted for reciprocating straight line movement in the housing, a pair of racks on the print head, a platen cooperable with the print head, an actuator disposed at the handle, a driver for advancing the carrier web, a delaminator for delaminating printed labels from the carrier web, an applicator for applying printed labels, the actuator being coupled to the driver and to the racks to print labels and to advance the carrier web, spaced apart straight guides within the housing, and guide rollers mounted on the print head in guided relationship in the guides.

7. A hand-held labeler for printing and applying pressure sensitive labels releasably secured to a carrier web, the labeler comprising: a housing having a left side portion, a right side portion and a handle, a print head mounted for reciprocating straight line movement in the housing, a pair of spaced racks on the print head, a platen cooperable with the print head, an actuator disposed at the handle, a driver for advancing the carrier web, an applicator for applying printed labels, the actuator being coupled to the driver and to the racks to print labels and to advance the carrier web, a straight guide in the left side portion, a straight guide in the right side portion, and guide rollers mounted on the print head in guided relationship in the guides.

* * * * *